US006834506B2

(12) United States Patent
Modi et al.

(10) Patent No.: US 6,834,506 B2
(45) Date of Patent: Dec. 28, 2004

(54) MAIN LIQUID FUEL INJECTION DEVICE FOR A SINGLE COMBUSTION CHAMBER, HAVING A PREMIXING CHAMBER, OF A GAS TURBINE WITH LOW EMISSION OF POLLUTANTS

(75) Inventors: Roberto Modi, San Piero a Sieve (IT); Gianni Ceccherini, Sesto Fiorentino (IT); Eugenio Del Puglia, Florence (IT)

(73) Assignee: Nuovo Pignone Holding S.p.A., Florence (IT)

( * ) Notice: Subject to any disclaimer, the term of this patent is extended or adjusted under 35 U.S.C. 154(b) by 41 days.

(21) Appl. No.: 10/320,680

(22) Filed: Dec. 17, 2002

(65) Prior Publication Data

US 2003/0121266 A1 Jul. 3, 2003

(30) Foreign Application Priority Data

Dec. 21, 2001 (IT) ..... MI2001A2780

(51) Int. Cl.[7] ..... F23R 3/30
(52) U.S. Cl. ..... 60/737; 60/740
(58) Field of Search ..... 60/737, 740, 747, 60/748, 746; 431/181, 182, 183

(56) References Cited

U.S. PATENT DOCUMENTS

| | | | | | |
|---|---|---|---|---|---|
| 3,455,108 | A | * | 7/1969 | Clare et al. | 60/749 |
| 3,682,390 | A | * | 8/1972 | Cheshire et al. | 60/748 |
| 4,154,056 | A | * | 5/1979 | Emory | 60/740 |
| 4,263,780 | A | * | 4/1981 | Stettler | 60/737 |
| 4,589,260 | A | * | 5/1986 | Krockow | 60/737 |
| 5,251,447 | A | * | 10/1993 | Joshi et al. | 60/737 |
| 6,094,904 | A | * | 8/2000 | Goodrich et al. | 60/748 |
| 6,178,752 | B1 | * | 1/2001 | Morford | 60/737 |
| 6,438,961 | B2 | * | 8/2002 | Tuthill et al. | 60/737 |
| 6,594,999 | B2 | * | 7/2003 | Mandai et al. | 60/722 |

FOREIGN PATENT DOCUMENTS

JP 60-126521 * 6/1985

* cited by examiner

*Primary Examiner*—Ted Kim
(74) *Attorney, Agent, or Firm*—Nixon & Vanderhye

(57) ABSTRACT

A main liquid fuel injection device (20) for a single combustion chamber (10), having a premixing chamber (12), of a gas turbine with low emission of pollutants, comprising a set of injection channels (42) for the liquid fuel distributed within the premixing chamber (12); the injection device (20) has a set of blades (32) extending radially about the axis of symmetry of the combustion chamber (10), each of which is provided with at least one of the injection channels (42).

15 Claims, 4 Drawing Sheets

MAIN LIQUID FUEL INJECTION DEVICE FOR A SINGLE COMBUSTION CHAMBER, HAVING A PREMIXING CHAMBER, OF A GAS TURBINE WITH LOW EMISSION OF POLLUTANTS

The present invention relates to a main liquid fuel injection device for a single combustion chamber, having a premixing chamber, of a gas turbine with low emission of pollutants.

As is known, a gas turbine is a machine consisting of a compressor and a turbine with one or more stages, in which these components are interconnected by a rotating shaft and in which at least one combustion chamber is provided between the compressor and the turbine. In particular, reference is made here to the case in which a single combustion chamber is present.

Air from the external environment is supplied to the compressor where it is pressurized.

The pressurized air passes through a premixing chamber terminating in a nozzle or converging portion. At least one injector supplies fuel to this chamber, this fuel being mixed with the air to form a fuel-air mix for combustion.

The fuel required for the combustion is therefore introduced into the combustion chamber from a pressurized network, the combustion process being designed to cause an increase in the temperature and enthalpy of the gas.

A parallel fuel supply system, for generating a pilot flame, is also generally provided in order to improve the stability characteristics of the flame.

Finally, the gas at high temperature and high pressure passes through suitable ducts to reach the various stages of the turbine, which converts the enthalpy of the gas into mechanical energy which is available to a user.

It is well known that the primary considerations in the design of combustion chambers for gas turbines are the flame stability and the control of excess air, the aim being to establish ideal conditions for the combustion.

There is also a tendency to provide a mixture of air and fuel, by means of the premixing chamber, in order to achieve combustion with reduced emissions, mainly of nitrogen oxide and carbon monoxide. This is done by optimizing the excess combustion air factor.

More specifically, the prior art provides a premixing chamber immediately upstream from the combustion chamber.

Both the premixing chamber and the combustion chamber are surrounded by a cavity containing pressurized air circulating in the opposite direction to the flow of combustion products leaving the combustion chamber.

The aforesaid air (taken from the outlet of the axial compressor) is used as combustion air to be mixed with the fuel in the premixing chamber, and as cooling air for cooling the combustion chamber and the combustion products.

In order to achieve low emission of pollutants, especially nitrogen oxide, at all levels of loading of the turbine, in the system described above the passage of the combustion air from the cavity to the premixing chamber, through apertures in the outer surface of the latter, can be constricted.

The constriction is applied as a function of the quantity of fuel used, in such a way that the ratio between combustion air and fuel is kept constant at the optimal value.

To prevent the flame from being extinguished or becoming unstable in any way, a set of burners is provided with converging axes positioned circumferentially around the outlet of the premixing chamber, so that a corresponding set of additional flames is created in the combustion region.

These burners are supplied independently with additional fuel and with high-pressure air obtained by further compression of the air supplied by the turbine's compressor; this air is sent to the burners through blades which are twisted so that an essentially helical motion is imparted to the air.

Thus, by using the additional flames of the burners, which are essentially pilot flames, not only is the main central combustion flame stabilized, preventing it from being extinguished, but, since the precise quantities of fuel and air used independently by the burners are known, the whole system can be regulated to achieve optimal and controlled ignition.

Furthermore, the quantity of additional fuel required for the burner flames becomes very low, and moreover it is entirely burnt in optimal conditions, so that the polluting emissions of nitrogen oxide are drastically reduced.

However, in order to reduce the emission of pollutants, it is essential that the liquid fuel injectors or main liquid fuel injection device provide a satisfactory distribution of the fuel-air mixture in the premixing chamber.

It is also necessary for the fuel supply channels to be kept clear, internally and externally, of carbon deposits which are formed as a result of the high temperature of the walls of the said channels.

It is therefore necessary to lower the temperature of the walls of the liquid supply channels, limiting their temperature to a maximum value: for example, General Electric usually specifies a maximum of 120° C.

For this purpose, the liquid fuel injector is provided with internal passages for the cooling air, these passages surrounding all the liquid fuel supply channels. This air is then injected into different points of the air and fuel premixing channel.

The object of the present invention is therefore to overcome the drawbacks mentioned above, and in particular to provide a main liquid fuel injection device for a single combustion chamber, having a premixing chamber, of a gas turbine, which ensures a low emission of pollutants.

Another object of the present invention is to provide a main liquid fuel injection device for a single combustion chamber, having a premixing chamber, of a gas turbine with low emission of pollutants which also provides good flame stability and reduces the pressure oscillations in the combustion chamber.

Yet another object of the present invention is to provide a main liquid fuel injection device for a single combustion chamber, having a premixing chamber, of a gas turbine with low emission of pollutants which provides high combustion efficiency.

An additional object of the present invention is to provide a main liquid fuel injection device for a single combustion chamber, having a premixing chamber, of a gas turbine with low emission of pollutants which enables the average life of components subject to high temperatures to be increased, by reducing the possibility of formation of carbon deposits.

Another additional object of the present invention is to provide a main liquid fuel injection device for a single combustion chamber, having a premixing chamber, of a gas turbine with low emission of pollutants which is particularly reliable, simple, and functional, and has relatively low production and maintenance costs.

Advantageously, the main liquid fuel injection device for a single combustion chamber, having a premixing chamber, of a gas turbine with low emission of pollutants injects and atomizes the liquid fuel to be mixed with the air, thus creating a good distribution of fuel-air mixture before the inlet of the combustion chamber.

Furthermore, the main liquid fuel injection device for a single combustion chamber, having a premixing chamber, of a gas turbine with low emission of pollutants also provides self-cooling of the walls which are subjected to high temperatures, and also makes it possible to protect the outer surfaces and the liquid fuel injection channels of the device against the damage caused by the deposition of carbon residues.

The characteristics and advantages of a main liquid fuel injection device for a single combustion chamber, having a premixing chamber, of a gas turbine with low emission of pollutants according to the present invention will be made clearer by the following description, provided by way of example, and without restrictive intent, with reference to the attached schematic drawings, in which.

Figure 1:
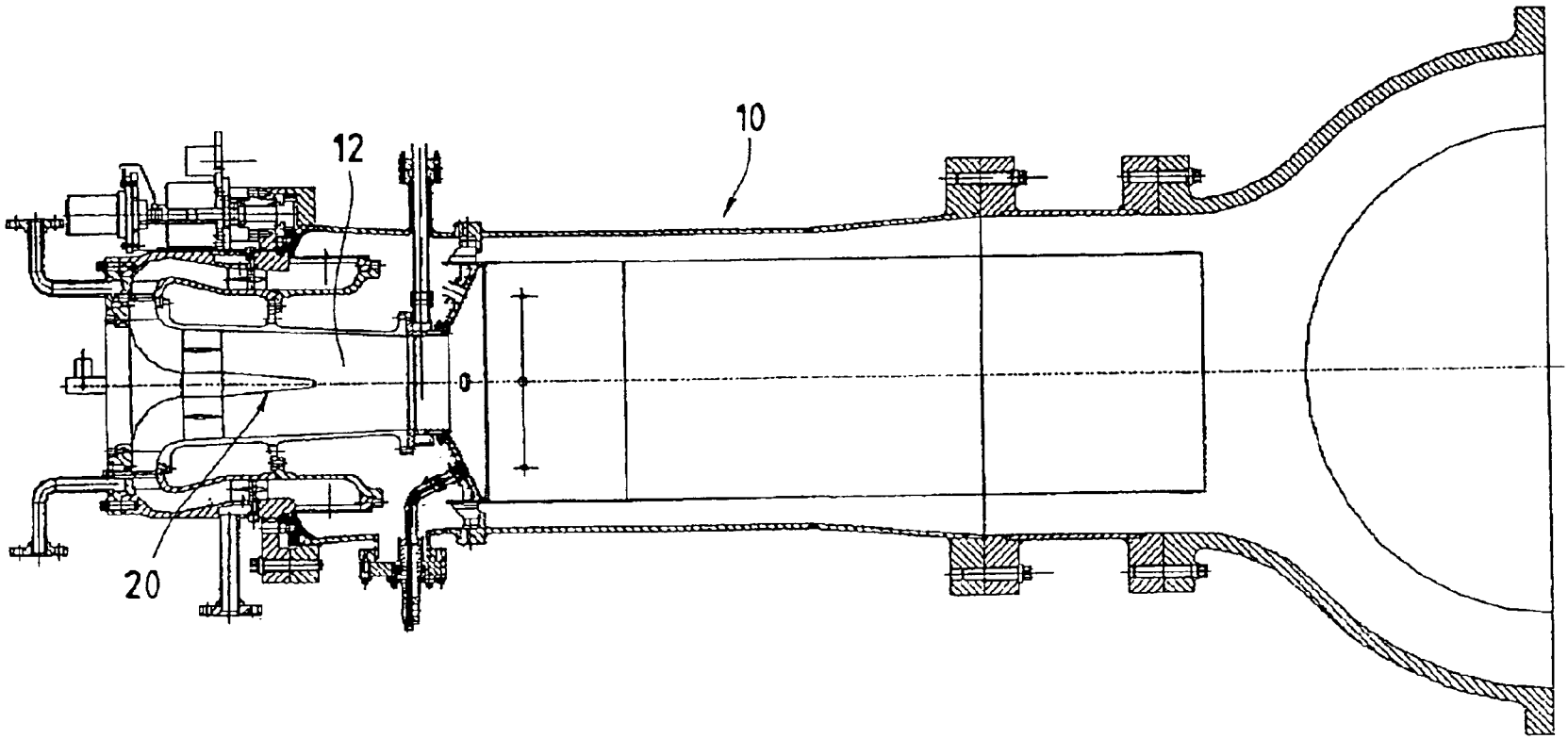
FIG. 1 is a longitudinal section through a single combustion chamber, having a premixing chamber, of a gas turbine with low emission of pollutants, showing the position of the main liquid fuel injection device according to the present invention.
Figure 2:
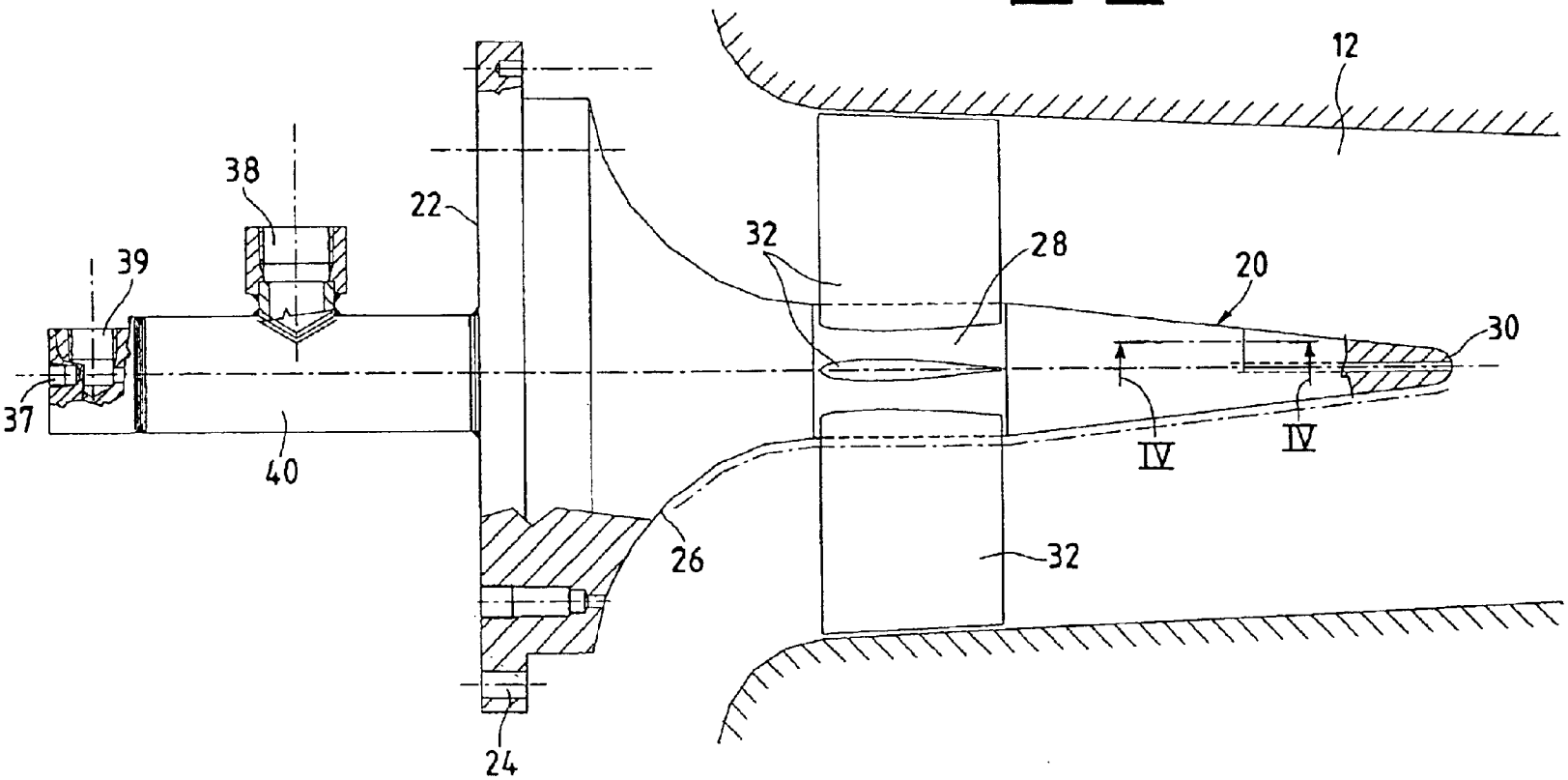
FIG. 2 is a longitudinal view, in partial section, of the main injection device of FIG. 1.
Figure 3:
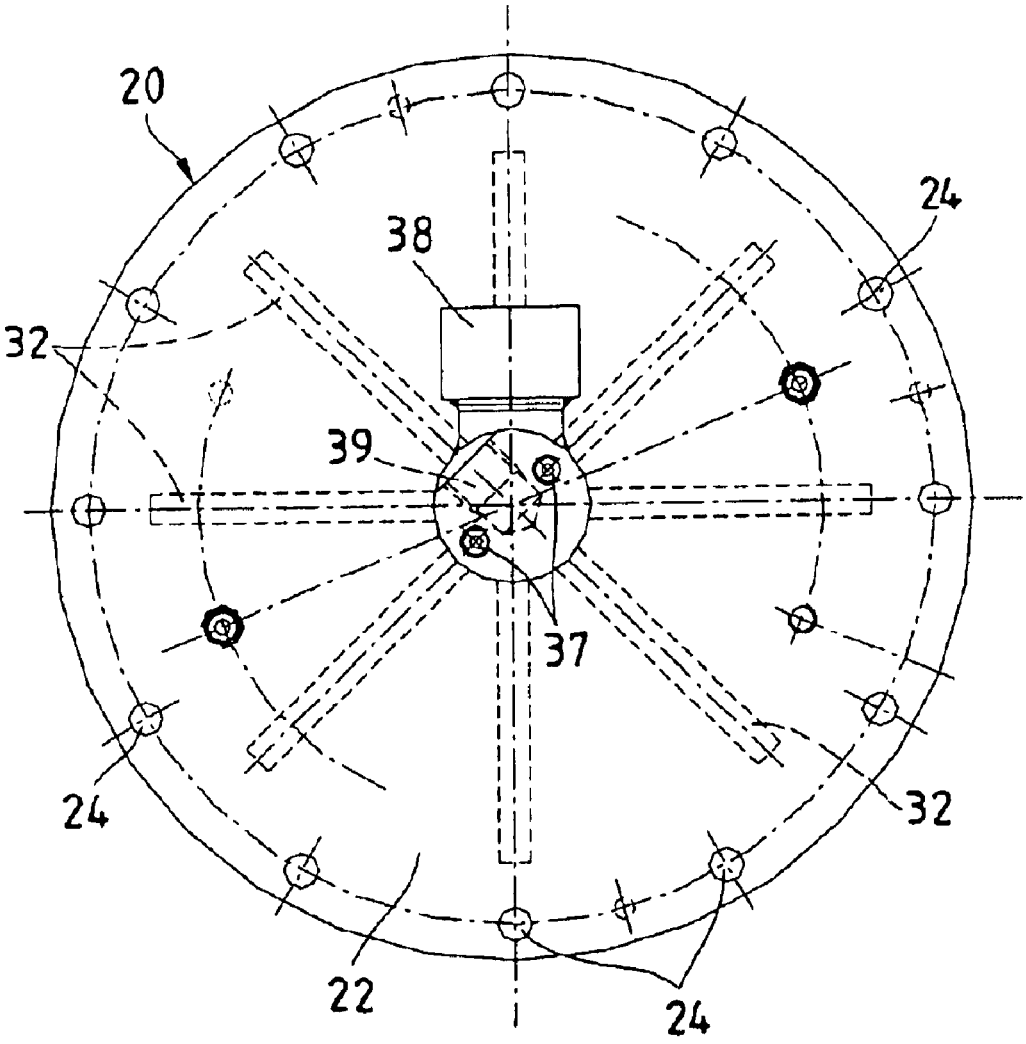
FIG. 3 is a plan view of the main injection device of FIG. 2.
Figure 4:
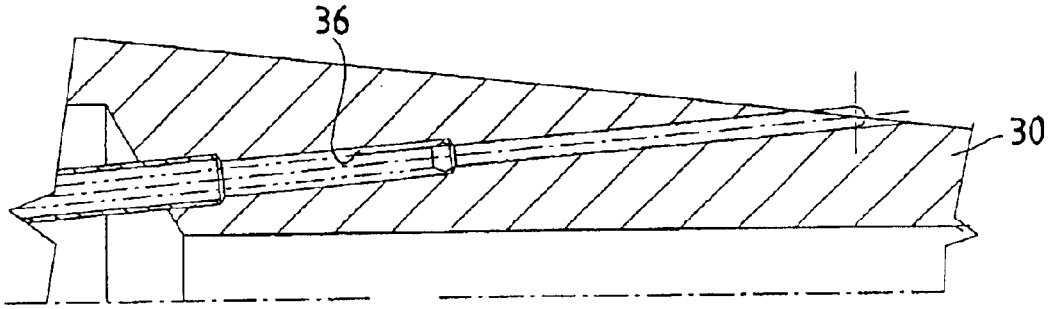
FIG. 4 shows a section of a detail of FIG. 2, taken through the plane IV—IV of FIG. 4.
Figure 5:
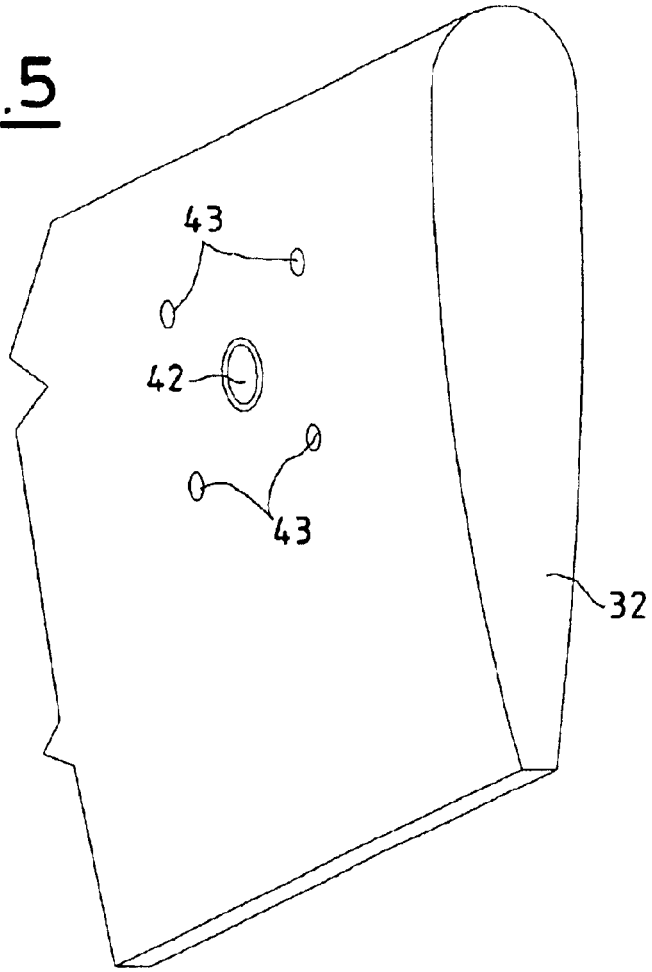
FIG. 5 is an enlarged axonometric view of a detail of FIG. 2, showing a blade for the injection of liquid fuel and cooling air.

With reference to FIG. 1, a single combustion chamber, indicated as a whole by the number 10, of a gas turbine with low emission of pollutants is shown, the gas turbine having a premixing chamber 12.

The premixing chamber 12 also has a main liquid fuel injection device 20 according to the present invention, shown in greater detail in FIGS. 2, 3, 4 and 5.

The main injection device 20 comprises an elongate structure with axial symmetry, which tapers towards the combustion region within the premixing chamber 12.

More precisely, the device 20 has a base 22, which is generally circular and is fixed on the axis of the premixing chamber 12, for example by means of bolts passing through a circumferential set of holes 24.

Upstream from the base 22 there is a cylindrical part 40 having a socket 38 for the entry of cooling air, a socket 39 for the entry of liquid fuel and inlets 37 for fixing flashback thermocouples, in other words safety devices for detecting flashback on to the said injection device 20.

Beyond the base 22, the injection device 20 is tapered through a large-radius connecting part 26 into an essentially cylindrical portion 28.

After this cylindrical structure 28, the device 20 is tapered again up to a rounded end 30, which is also described as the "nose".

At the apex of the nose 30, the injector has a hole to allow the cooling air to enter the premixing chamber 12. The cooling air is used to cool channels for the passage of liquid fuel, thus preventing the formation of carbon residues.

A set of blades 32, consisting of eight blades for example, is provided around the cylindrical portion 28, the blades being positioned radially with respect to the axis of the device 20, at equal intervals.

The blades 32 have a neutral airfoil profile and extend in the axial direction. Each blade 32 has, on at least one lateral surface, at least one injection channel 42 for the liquid fuel and at least one cooling air injection point 43.

Two flashback thermocouples are provided on the device 20. These thermocouples are easily installed in the correct position by means of the guides 36, shown in FIG. 4, which start in the inlet 37 and terminate in the proximity of the nose 30.

In a preferred embodiment, these thermocouples are provided both at the rounded end 30 and on the walls of the chamber 12.

In one embodiment, described by way of example and without restrictive intent, there are two thermocouples on the rounded end 30 and four on the walls of the chamber 12.

The operation of the main liquid fuel injection device 20 for a single combustion chamber 10, having a premixing chamber 12, of a gas turbine with low emission of pollutants according to the invention is clear from what is described above with reference to the figures, and is briefly as follows.

The liquid fuel is injected through the blades 32 tangentially, in other words in a perpendicular direction with respect to the flow of air passing through the blades 32.

These blades 32 are located in the main duct of the premixing chamber 12, which receives air which has been preheated by the compression provided by the turbine's compressor.

Thus a mixing optimally distributed between liquid fuel and air is achieved before the entry to the combustion region.

At the same time, the cooling air is injected into the premixing chamber 12, from each blade 32 and also from the apex of the nose 30, this cooling air being used to keep the temperature of the liquid fuel supply channels 42 low, and thus prevent the formation of carbon residues.

The cooling air is supplied to the inlet of the socket 38 at stabilized pressure and temperature.

The thermocouples, starting with those positioned at the rounded end 30, detect dangerous flashbacks, and if these are detected they send information through transducers to the turbine control unit.

It should be emphasized here that, in combustion chambers used in the prior art, in order to provide a distribution of the mixing between liquid fuel and air comparable to that obtained with the main injection device according to the present invention, use is made of multiple combustion chambers or chambers of annular shape with a plurality of injection points, instead of a single combustion chamber as in the case to which the present patent application relates.

It should also be emphasized that, where there is a single combustion chamber, the importance of good distribution of mixing between the liquid fuel and air becomes even more critical than in the case of multiple or annular combustion chambers, and that the required distribution of mixing can be achieved with the main liquid fuel injection device for a single combustion chamber, having a premixing chamber, of a gas turbine with low emission of pollutants according to the present invention.

The above description clearly indicates the characteristics of the main liquid fuel injection device for a single combustion chamber, having a premixing chamber, of a gas turbine with low emission of pollutants, which is the object of the present invention, and also makes clear the corresponding advantages, which include:

- reduced pressure oscillations in the combustion chamber and good flame stability;
- high combustion efficiency;
- an increased average life of the components which are subjected to high temperatures;
- simple and reliable use;
- protection against the damage caused by the deposition of carbon residues produced during combustion;

reduced costs and simpler installation and maintenance, by comparison with a solution in which a multiple or annular combustion chamber is used according to the prior art to provide a distribution of mixing between fuel and air comparable with that obtained by providing a device according to the invention.

The main liquid fuel injection device for a single combustion chamber, having a premixing chamber, of a gas turbine with low emission of pollutants according to the present invention has yielded excellent results in laboratory tests, providing an excellent distribution of air and fuel mixing after the device, even when the position of the device along the axis is varied slightly.

Additionally, after a few hours of operation of the gas turbine at full load, no carbon deposits were found on the blades, and all the injection channels were found to be clear and clean.

Finally, it is evident that main liquid fuel injection device for a single combustion chamber, having a premixing chamber, of a gas turbine with low emission of pollutants, designed in this way can be modified and varied in numerous ways, all included within the scope of the invention.

Moreover, all the components can be replaced with technically equivalent elements. In practice, the materials used, as well as the shapes and dimensions, can be varied at will according to technical requirements.

The scope of protection of the invention is therefore delimited by the attached claims.

What is claimed is:

1. A main liquid fuel injection device for a combustion chamber of a gas turbine having a premixing chamber comprising:

a plurality of generally radially extending, circumferentially spaced blades arranged about an axis of symmetry, each said blade having at least one fuel supply channel for receiving liquid fuel and injecting the fuel through a fuel injection port along a surface of the blade into the premixing chamber, each said blade having at least one cooling air supply channel for receiving cooling air and injecting the air through a cooling air injection port along a surface of the blade spaced from said fuel injection port and into the premixing chamber, enabling the flow of cooling air from the at least one cooling air supply channel to cool the blades; wherein said at least one cooling air supply channel and said at least one fuel supply channel in each blade are arranged in heat exchange relation relative to one another, enabling the flow of cooling air in the at least one cooling air supply channel to cool the at least one fuel supply channel, thereby minimizing or eliminating deposition of carbon residue on blade surfaces.

2. A device according to claim 1 wherein the blade includes a plurality of cooling air supply channels having exit ports along said blade surface surrounding such fuel injection port for cooling blade surface portions about the fuel supply exit ports.

3. A device according to claim 1 wherein said blade includes a plurality of cooling air supply channels having air injection ports along said blade surface surrounding the fuel supply injection port for cooling blade surface portions about the fuel supply injection port, said cooling air supply channel and said fuel supply channels in each blade being arranged in heat exchange relation relative to one another, enabling the flow of cooling air in the cooling air supply channel to cool the fuel supply channel.

4. A device according to claim 1 including an elongated structure having axial symmetry for mounting the blades and which structure is tapered towards a combustion region within the combustion chamber.

5. A device according to claim 1 including a base fixed on the axis of said premixing chamber.

6. A device according to claim 5 wherein said first base is circular at one end thereof and is fixed by means of bolts passing through a circumferential set of holes adjacent said one end.

7. A device according to claim 5 wherein said base is tapered toward said premixing chamber and forms a cylindrical portion carrying said blades.

8. A device according to claim 7 wherein said cylindrical portion extends in a downstream direction and tapers into a rounded end.

9. A device according to claim 5 including thermocouples carried by said base for detecting any flashback onto said device.

10. A device according to claim 9 wherein said cylindrical portion extends in a downstream direction and tapers into a rounded end, said thermocouples being provided at said rounded end.

11. A device according to claim 10 including guides for receiving said thermocouples, said guides diverging relative to the axis of the device.

12. A device according to claim 10 wherein the thermocouples send information through transducers to a control unit of the turbine.

13. A device according to claim 1 wherein said blades have a neutral airfoil profile and extend along an axial direction, said fuel and said air injection ports opening through at least one lateral surface of each said blade.

14. A device according to claim 1 including a base mounting said blades and terminating downstream of said blades in a rounded end, said base having a hole for supplying cooling air through the base and the rounded end thereof.

15. A device according to claim 1 wherein said blades are positioned at equal intervals about the axis and are eight in number.

* * * * *